United States Patent [19]

Hill

[11] 4,161,290

[45] Jul. 17, 1979

[54] WATERING DEVICE

[76] Inventor: J. Ernest Hill, 3114 Linkwood, Houston, Tex. 77025

[21] Appl. No.: 855,551

[22] Filed: Nov. 29, 1977

Related U.S. Application Data

[63] Continuation-in-part of Ser. No. 727,033, Sep. 27, 1976, abandoned.

[51] Int. Cl.[2] ..... B05B 1/16

[52] U.S. Cl. ..... 239/396; 239/499; 239/542; 239/567

[58] Field of Search ..... 239/499, 542, 533.3, 239/533.5, 559, 567, 396; 138/45 A

[56] References Cited

U.S. PATENT DOCUMENTS

| | | | |
|---|---|---|---|
| 2,359,690 | 10/1944 | Tarbox | 239/553.3 |
| 2,420,958 | 5/1947 | Landreth | 239/542 |
| 2,477,204 | 7/1949 | Ravine | 239/553.3 |
| 2,515,600 | 7/1950 | Hayes | 239/542 X |
| 3,221,996 | 12/1965 | Emmert et al. | 239/542 |
| 3,430,867 | 3/1969 | Rodgers et al. | 239/542 |
| 3,762,650 | 10/1973 | Radecki | 239/396 |
| 3,777,987 | 12/1973 | Allport | 239/553.3 |

*Primary Examiner*—Robert W. Saifer

*Attorney, Agent, or Firm*—Robert W. B. Dickerson

[57] ABSTRACT

A fitting coupled to a water source, comprising an orifice, means for regulating the quantity of water passing through said orifice, an abutment for water passing through said orifice, and laterally displaced water outlet means.

2 Claims, 4 Drawing Figures

WATERING DEVICE

BACKGROUND OF THE INVENTION

This application is a continuation-in-part of Ser. No. 727,033 filed Sept. 27, 1976 and now abandoned.

When watering or soaking one's garden, or individual plants therein, at least two basic problems are encountered with present state of the art devices, such as U.S. Pat. Nos. 800,136; 2,213,955; and 3,034,733. First, when slow soaking action is deisrable, control of the valve at the source, i.e., faucet, is difficult, especially at slow discharge rates, for there is a shut-off tendency. Second, with sufficient pressure, water tends to jet from present day fixtures, causing erosion. Applicant's device was designed to overcome these two problems, as well as provide an important ancillary feature, to wit assist in preventing freezing of water in pipes during cold weather.

SUMMARY OF THE INVENTION

A cap, or threaded member, is engageable with a faucet hose fitting. Said cap includes an orifice or fluid passageway therethrough. Fixed to the cap is at least one mixing or turbulence-causing chambers having an aperture or apertures for a bubbling release of water. Multi-positionable disc means may be provided to regulate the amount of water passing through said fluid passageway.

DESCRIPTION OF THE INVENTION

Figure 2:
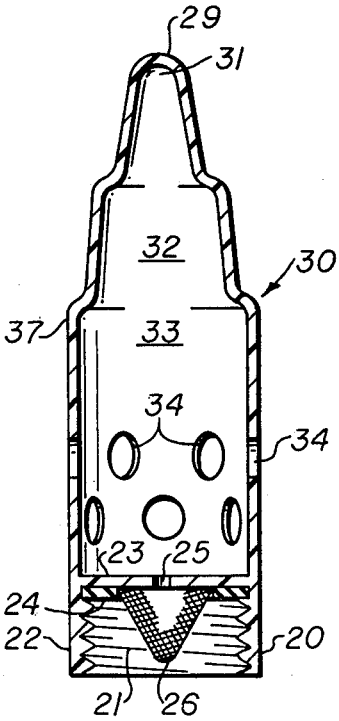
FIG. 2 is a vertical section taken along lines 2—2 of FIG. 1.

Looking at the embodiment, particularly of FIG. 2, a source of water, such as a hose 10, would be threadedly engageable with the internal threads 21 of a cap or connector portion 20 of this invention. Such cap would have an annular depending skirt 22 connected at one end by web 23. Adjacent the underside of web 23 is annular gasket 24. Centrally of web 23 is an aperture or orifice 25. Positioned adjacent web 23 by gasket 24 is sieve or filter 26, to remove contaminants from the water source before passing through orifice 25.

Depending from cap 20, opposite skirt 22, is chamber forming member 30. Such member may be formed of plastic, or other similar substance, and basically be of nipple configuration. Internal connecting chambers are depicted as being formed within the skin 37 of member 30, such chambers 31, 32 and 33 being of different diameters, caused by a progressive narrowing of member 30, moving from its base to its top. A plurality of apertures or openings 34 establish communication between the inside of member 30, and the exterior.

In use, water from an outside source would be provided hose 10, such as by turning on a faucet. After passing through screen 26 of cap 20, a portion of the fluid would pass through orifice 25. By virtue of such restricted passageway, the source valve may be opened to a substantial degree, thereby overcoming the tendency of valve closure when only opened a modest amount. Water passing through orifice 25 under substantial pressure would jet upwardly, to strike the closed end 29 of member 30, adjacent chamber 31 and being deflected thereby. Thereafter, such water, having encountered such closed end, would bounce off, and tend to run back toward cap 20, creating turbulence within chamber 31, and to varying degrees within connecting chambers 32 and 33, before exiting through apertures 34. The existence of such turbulence chamber of chambers tends to cause a steady bubbling release of water, rather than a jetting action, resulting in a decrease in erosion. A further benefit is obvious during cold weather. By leaving a faucet on, freezing may be controlled.

Figure 1:
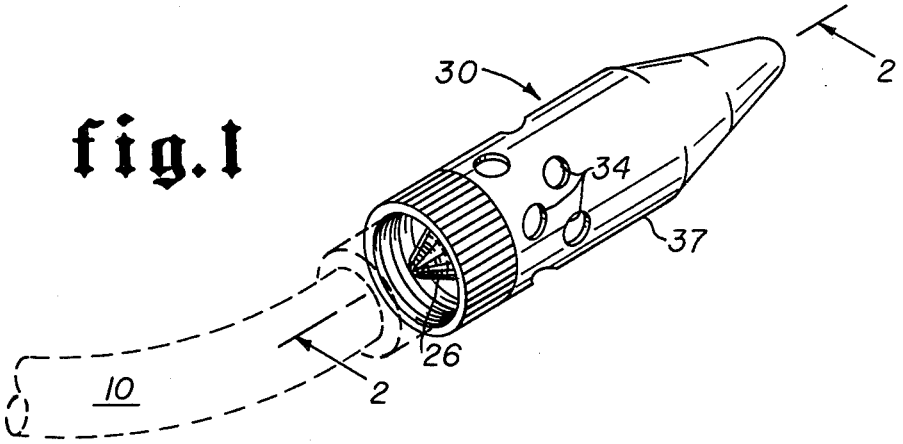
FIG. 1 is a perspective of one embodiment of the device.
Figure 3:
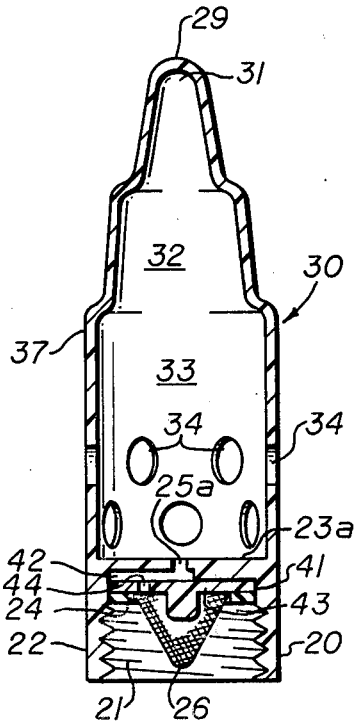
FIG. 3 is a vertical section of another embodiment of the device.
Figure 4:
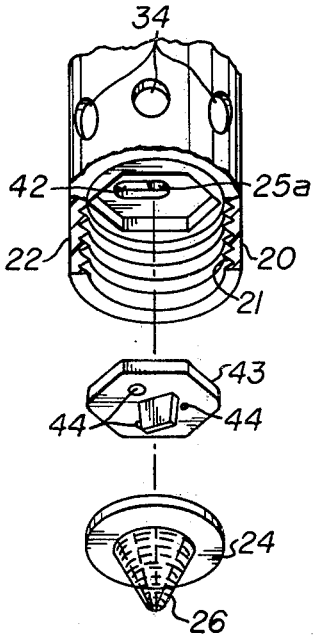
FIG. 4 is an exploded perspective of the cap web, flow-adjusting disc, and screen of the embodiment of FIG. 3.

In the embodiment of FIGS. 3 and 4, web **23*a* may be an integral portion of cap 20, or may be separately formed connecting the interior diameter of member 30. In any case, such web includes bore 41. In the drawings, such bore is of hexagonal configuration. Web 23*a* also includes longitudinal counter bore 42, which communicates with both bore 41 and orifice 25*a*. Removably positioned within web bore 41 is disc 43, of a configuration correlative with that of bore portion 41. Disc 43 includes a plurality of fluid passageways 44, of differing diameters, passing therethrough. In any given position, one and only one of such passageways 44 establishes fluid communication between the bore or slot 42 (and thereby with orifice 25*a*) and a source of fluid as may be provided by hose 10. A grip tab 46 permits removal and rotation of disc (actually a valve) 43, so as to shift passageways 44 and thereby control the quantity of fluid entering within member 30. Thereafter, the operation of this embodiment would be like that of FIG. 2**.

Although limited embodiments have been described, it should be obvious that numerous modifications would be possible by one skilled in the art without departing from the spirit of the invention, the scope of which is limited only by the following claims.

I claim:

1. A device for controlling the flow of liquid, comprising:

a connector portion including;

a threaded skirt portion adapted for engagement with a liquid source, web portion separating said threaded portion from the interior of a nipple member, an axial bore of at least three sided configuration adapted to receive a movable disc between the walls of said skirt portion, and a lateral bore within said web portion in communication with said axial bore, orifice means through said web portion in communication with said nipple member and said lateral bore, movable disc member, correlative in diametrical configuration with said axial bore, having a said aperture being so spaced that only one may communicate with said lateral bore at one time, plurality of differently sized apertures therethrough, and a nipple member adjacent said web portion opposite said connector skirt portion including;

deflector means at one end thereof, at least one turbulence chamber adjacent said deflector means, and aperture means through the wall of said nipple member.

2. The device of claim 1 wherein said nipple member includes a plurality of communicating turbulence chambers.

* * * * *